US011486203B2

(12) United States Patent
Gramstad et al.

(10) Patent No.: US 11,486,203 B2
(45) Date of Patent: Nov. 1, 2022

(54) WELL OPERATIONS USING FLEXIBLE ELONGATE MEMBERS

(71) Applicant: TIOS AS, Stavanger (NO)

(72) Inventors: Bernt Gramstad, Ålgård (NO); Trond Eivind Larsen, Kvernaland (NO); Kjartan Ertenstein, Sola (NO); Vidar Haugen, Mosterøy (NO); Ove Kalvatn, Stavanger (NO); Anders Olsen, Kvitsøy (NO)

(73) Assignee: TIOS AS, Stavanger (NO)

( * ) Notice: Subject to any disclaimer, the term of this patent is extended or adjusted under 35 U.S.C. 154(b) by 0 days.

(21) Appl. No.: 16/971,803

(22) PCT Filed: Mar. 6, 2019

(86) PCT No.: PCT/NO2019/050053
§ 371 (c)(1),
(2) Date: Aug. 21, 2020

(87) PCT Pub. No.: WO2019/172779
PCT Pub. Date: Sep. 12, 2019

(65) Prior Publication Data

US 2021/0032937 A1 Feb. 4, 2021

(30) Foreign Application Priority Data

Mar. 6, 2018 (NO) ..... 20180331

(51) Int. Cl.
*E21B 7/12* (2006.01)
*E21B 15/02* (2006.01)
(Continued)

(52) U.S. Cl.
CPC ..... *E21B 15/02* (2013.01); *E21B 7/12* (2013.01); *E21B 19/002* (2013.01); *E21B 33/076* (2013.01)

(58) Field of Classification Search
CPC ..... E21B 7/12; E21B 15/02; E21B 19/002; E21B 33/076
See application file for complete search history.

(56) References Cited

U.S. PATENT DOCUMENTS 4,819,730 A * 4/1989 Williford ..... E21B 7/128 114/144 B
6,056,071 A * 5/2000 Scott ..... B63B 35/4413 175/5
(Continued)

FOREIGN PATENT DOCUMENTS

GB 2387187 10/2003
WO 2008118680 10/2008
(Continued)

OTHER PUBLICATIONS

Norwegian Search Report for 20180331, dated Oct. 1, 2018.
International Search Report and the Written Opinion for PCT/N02019/050053, dated May 22, 2019.

*Primary Examiner* — Matthew R Buck
(74) *Attorney, Agent, or Firm* — Andrus Intellectual Property Law, LLP

(57) ABSTRACT

A method is for performing work in a well and on a vessel. A wellbore assembly such as a tool string is suspended on a first flexible elongate member from the vessel. The wellbore assembly is used to perform work in the well. The wellbore assembly such as a tool string is suspended on a second flexible elongate member from the vessel. The wellbore assembly on the first flexible elongate member is removed from the well, and after the removal, the wellbore assembly on the second flexible elongate member is inserted into the well. The inserted wellbore assembly in the well can then be used to perform further work. The wellbore assemblies may be deployed and retrieved on independently operable wire-lines. A related vessel and apparatus is also described.

21 Claims, 7 Drawing Sheets

(51) Int. Cl.
*E21B 19/00* (2006.01)
*E21B 33/076* (2006.01)

(56) References Cited

U.S. PATENT DOCUMENTS

| | | | | |
|---|---|---|---|---|
| 6,352,114 | B1 * | 3/2002 | Toalson | E21B 17/01 166/339 |
| 6,443,240 | B1 * | 9/2002 | Scott | E21B 17/01 166/358 |
| 7,798,232 | B2 * | 9/2010 | Headworth | E21B 33/038 166/352 |
| 8,733,472 | B2 * | 5/2014 | Magnuson | E21B 19/143 175/7 |
| 8,807,223 | B2 * | 8/2014 | Smith | E21B 33/076 166/335 |
| 8,973,665 | B2 * | 3/2015 | Sbordone | E21B 33/076 166/345 |
| 2010/0071906 | A1 | 3/2010 | Rodrigues | |
| 2011/0017511 | A1 * | 1/2011 | Payne | E21B 19/002 175/7 |
| 2012/0273219 | A1 | 11/2012 | Hoffman et al. | |
| 2013/0269948 | A1 | 10/2013 | Hoffman | |
| 2016/0090794 | A1 | 3/2016 | Holck | |
| 2018/0266194 | A1 * | 9/2018 | Turner | E21B 17/20 |

FOREIGN PATENT DOCUMENTS

| | | |
|---|---|---|
| WO | 2014108541 | 7/2014 |
| WO | 2016144165 | 9/2016 |
| WO | 2017049071 | 3/2017 |

* cited by examiner

WELL OPERATIONS USING FLEXIBLE ELONGATE MEMBERS

CROSS-REFERENCE TO RELATED APPLICATIONS

This application is the U.S. national stage application of International Application PCT/NO2019/050053, filed Mar. 6, 2019, which international application was published on Sep. 12, 2019, as International Publication WO 2019/172779 in the English language. The International Application claims priority of Norwegian Patent Application No. 20180331, filed Mar. 6, 2018. The international application and Norwegian application are both incorporated herein by reference, in entirety.

TECHNICAL FIELD

The present invention relates in particular to well operations, such as for deploying and retrieving wellbore assemblies on flexible elongate members for performing well intervention work in wells.

BACKGROUND

Flexible elongate members are commonly used in the oil and gas production and exploration industry to facilitate accessing and performing work in wells. In order to perform intervention work in a well, a wellbore assembly comprising tools, e.g. a tool string, for performing the work may be fitted to the flexible elongate member. The type of flexible elongate member to be used can depend on requirements and the wellbore assembly to be deployed. The flexible elongate member can for example be one of the following: a wireline; a slickline; a rod or a cable, e.g. a tubular rod or cable, of for example synthetic fibre, metal(s), plastics, or composite material; a hose; an e-line cable; or coiled tubing; and may be spooled in or out from a drum in use. Wellbore assemblies for light well intervention work are often implemented on wirelines.

Recent advances have seen wireline-based light well intervention services on subsea completed oil and gas wells being regularly carried out from mono-hull light intervention vessels. In conducting such activity, the vessel is dynamically positioned over the wellhead and a subsea well access system is deployed from the vessel and connected to the subsea well. Following the deployment of the well access system, the tool string is prepared and deployed on the wireline through the water column, through the well access system, and into the well. Often, the work needed on the well means multiple wireline runs are needed, which can be time consuming, costly and/or inefficient.

There exists a need for more efficient solutions in the provision and deployment of well assemblies such as on wireline-based services, e.g. in the provision of light well intervention services.

SUMMARY OF THE INVENTION

According to a first aspect of the invention, there is provided a method of performing work, e.g. intervention work, in a subsea well, the method comprising the steps of: (a) providing a vessel; (b) suspending a wellbore assembly, e.g. a tool string, on a first flexible elongate member from the vessel, using the wellbore assembly to perform work in the well; (c) suspending a wellbore assembly, e.g. a tool string, on a second flexible elongate member from the vessel; (d) removing the wellbore assembly on the first flexible elongate member from the well; (e) after step d, inserting the wellbore assembly on the second flexible elongate member into the well; and (f) using the inserted wellbore assembly in the well to perform further work.

The vessel is preferably a light well intervention vessel, e.g. of mono-hull type. The vessel is preferably equipped with a dynamic positioning system.

The tool string being removed on the first flexible elongate member typically passes the tool string in standby on the second flexible elongate member, upon performing either or both of steps (d) and (e).

Either of the first and second flexible elongate members may comprise a flexible elongate member as described anywhere herein, for example a wireline or similar. The wellbore assembly, on either or both of the first and second flexible elongate members, may comprise a tool string. The wellbore assembly, on either or both of the first and second flexible elongate members, may be a bottom hole assembly.

The method, e.g. step c may typically include locating the suspended assembly on the second flexible elongate member in the sea. The wellbore assembly on the second flexible elongate member may be located in the sea during a period of time. In this period of time, the wellbore assembly on the first flexible elongate member may be: used in the well; used in an access system of the well; located in the sea but obstructing or restricting access to the well; or inserted into the well or the access system. Thus, the wellbore assembly on the second flexible elongate member may be on standby in the sea, near the well, ready for insertion into the well as soon as possible.

The method may further comprise a step of retrieving the removed wellbore assembly from the well on the first flexible elongate member toward surface. Step e may comprise inserting the wellbore assembly on the second flexible elongate member into the well, or into an access system on the well, or using the wellbore assembly on the second flexible elongate member in the well in the period of retrieving or during which the wellbore assembly is retrieved on the first flexible elongate member. The retrieval may be performed by spooling in the first flexible elongate member.

Step e may comprise, and/or the method may include, inserting the wellbore assembly on the second flexible elongate member into the well or into an access system on the well (i) before the removed wellbore assembly on the first flexible elongate member has arrived at or near the vessel, (ii) before the removed wellbore assembly on the first flexible elongate member is received in a moon pool of the vessel, and/or (iii) before the removed wellbore assembly on the first flexible elongate member obtains a position in the sea upon retrieval that is nearer the vessel than the well, nearer the vessel than the access system on the well, or nearer the vessel than the seabed.

The wellbore assemblies can be respectively suspended on the first and second flexible elongate members at a common time or during a common period of time. The wellbore assembly on the first flexible elongate member may be removed in step d so as to allow the wellbore assembly on the second flexible elongate member to access the well.

The wellbore assembly on the second flexible elongate member may be located in the sea at a time or during a period of time (i) before the wellbore assembly on the first flexible member has been removed from the well, (ii) before the wellbore assembly on the first flexible member has been removed from an access system on the well, (iii) before retrieving the vessel the wellbore assembly on the first flexible elongate member has been retrieved to the vessel, and/or (iv) before the wellbore assembly on the first flexible elongate member has been pulled toward surface and obtained clearance sufficient to allow the wellbore assembly on the second flexible elongate member to be positioned in the sea for access to the well or the access system on the well.

Step c may be performed such that the suspended assembly on the second flexible elongate member may be located in the sea at a time the well or an access system on the well may be occupied or obstructed by the suspended wellbore assembly on the first flexible elongate member.

The wellbore assembly on the second flexible elongate member may typically be inserted into an entrance of the subsea well before recovering the wellbore assembly on the first flexible elongate member to the surface and/or bringing it onboard the vessel.

The method may include providing the subsea well with a subsea well access system.

The well access system may typically comprise an upper end which may be located subsea, wherein the wellbore assembly on the second flexible elongate member may be inserted into the well through the upper end of the access system. The well access system may comprise a lubricator, and the method may further comprise inserting the wellbore assembly on the second wireline into the lubricator.

The method may further comprise using an underwater manipulator to urge the second flexible elongate member laterally to help to align the wellbore assembly on the second flexible elongate member with an entrance for accessing the well, e.g. the underwater entrance to the access system which may be provided on the well.

The method may further comprise deploying or recovered the wellbore assemblies on the respective first and second flexible elongate members into the water through at least one moon pool of the vessel. In the case of deploying or recovering wellbore assemblies through at least one moon pool, the wellbore assembly on the first wireline may be deployed or recovered through a first moon pool of the vessel, and the wellbore assembly on the second flexible elongate member may be deployed or recovered through a second moon pool of the vessel. Alternatively, the wellbore assembly on the first flexible elongate member may be deployed or recovered through a first region of water of the moon pool, and the wellbore assembly on the second flexible elongate member may be deployed or recovered through a second region of water of the moon pool. The first and second regions of water of the moon pool may comprise opposite side regions or respective corner portions of the moon pool.

The well access system may comprise any one or more of: a lubricator configured to house a wellbore assembly, e.g. a tool string on the first or second flexible elongate member; a well control package; at least one valve operable for opening access between the lubricator and a wellbore of the well; pressurisation means for pressurising or depressurising an interior of the lubricator e.g. when housing the wellbore assembly; at least one blowout preventer.

The method may further include, prior to using the wellbore assembly on the first wireline to perform work, e.g. intervention work, providing the well with the well access system by suspending at least one part of the well access system on one of the first or second flexible elongate members, and using the flexible elongate member to position and arrange the part for connection to the well. The method may then further comprise suspending a wellbore assembly on the other of the first and second flexible elongate members in the sea, e.g. in a standby location near a subsea entrance of the well access system. The method may further comprise connecting the part of the well access system to the well, e.g. connecting the part to a valve tree of the well, the wellbore assembly being suspended in the sea, e.g. the standby location during a period in which connection of the part takes place. The method may further comprise deploying the part of the well access system through a moon pool of the vessel.

According to a second aspect of the invention, there is provided a method of deploying and retrieving wellbore assemblies, the method comprising: providing a vessel having independently operable first and second spool units; operating the first spool unit to spool in a first flexible elongate member to remove and retrieve a wellbore assembly from a well on an end of the first flexible elongate member; and operating the second spool unit to spool out a second flexible elongate member to deploy and insert a further wellbore assembly into the well on an end of the second flexible elongate member.

According to a third aspect of the invention, there is provided a method of performing an intervention or work programme for subsea wells, which comprises performing the method in accordance with the first or second aspects of the invention in any one or more of the wells in the programme to perform the work, e.g. intervention work. The method may include sailing the vessel between a first location to perform work, e.g. intervention work on one well and a second location to perform work, e.g. intervention work on another well.

According to a fourth aspect of the invention, there is provided apparatus for use in performing the method in accordance with any of the first to third aspects, the apparatus comprising first and second flexible elongate members each comprising an end to be connected to a wellbore assembly, e.g. tool string, and independently spoolable.

In this way, the apparatus may provide for dual operability, e.g. dual wireline operability, where first and second flexible elongate members may support and simultaneously suspend two wellbore assemblies from a supporting structure, e.g. frame. The frame may preferably be capable of supporting wellbore assemblies simultaneously suspended from the frame on the first and second wirelines. The apparatus can further comprise the first and second flexible elongate members for performing the work, e.g. intervention work.

The apparatus can further comprise at least one spool unit, e.g. winch. The spool unit can comprise a storage drum for storing a wound length of a flexible elongate member on the drum. The spool unit can be operable for spooling out or in be arranged for spooling out a length of wireline from the drum. The spool unit may be coupled to at least one motor arranged to drive the spool unit to spool the wireline in or out. The first and second flexible elongate members are coupled to the spool unit(s), e.g. winch(es), to be spoolable independently in or out from the spool unit(s), e.g. winch(es).

The apparatus may further comprise heave compensation means to maintain a position of the wellbore assemblies on an end of a spooled-out length of the first or second flexible elongate member. The apparatus may further comprise a frame. The heave compensation means may adapt a spooled-out length of the first and/or second flexible elongate member relative to the frame or the vessel for compensating for heave motion. Heave motion may comprise up/down movement imparted by sea, e.g. when the frame is on a vessel. The vessel on which the frame may be located, and/or spool unit(s) e.g. winch(es) may be provided, and/or the supports on the frame for the first and second flexible elongate members, may experience heave motion, such that the position of the frame, spool unit(s) e.g. winch(es), vessel hull, and/or supports may change spatially relative to the seabed. The heave compensation means may compensate for such changes, e.g. to maintain the position(s) of the wellbore assembly or assemblies.

According to a fifth aspect of the invention, there is provided apparatus for dual deployment and retrieval of wellbore assemblies, the apparatus comprising: first and second spool units; first and second flexible elongate members which are spoolable independently in or out on the first and second spool units respectively; a wellbore assembly to be deployed or retrieved on the first flexible elongate member; a wellbore assembly to be deployed or retrieved on the second flexible elongate member.

In at least one mode of dual operation, the first unit may be operative to spool in the first flexible wireline to remove and retrieve a wellbore assembly from a well on the first flexible elongate member and the second unit may be operative to spool out the second flexible wireline to deploy and insert a further wellbore assembly into the well on the second flexible elongate member.

According to a sixth aspect of the invention, there is provided a vessel, e.g. a light well intervention vessel, for use in a method according to any of the first to third aspects of the invention.

According to a seventh aspect of the invention, there is provided a vessel including the apparatus in accordance with the fourth or fifth aspect of the invention. The vessel preferably includes a tower, which may comprise a frame. The first and second flexible elongate members may be arranged to be supported in independent spooling relationship along the tower.

The light well intervention vessel may further comprise at least one moon pool through which both the first and second flexible elongate members can pass for suspending first and second wellbore assemblies on the first and second flexible elongate members in the water below the vessel.

The light well intervention vessel may further comprise a first moon pool through which the first flexible elongate member can pass and a second moon pool through which the second flexible elongate member can pass, for suspending first and second wellbore assemblies on the first and second flexible elongate members in the water simultaneously below the vessel. The first and second moon pools may be arranged transversely apart in the hull of the vessel.

Any of the first to the seventh aspects of the invention may have one or more further features as set out in relation to any other of the aspects, wherever such features are disclosed herein.

Various embodiments of the invention are advantageous as apparent from throughout the present specification. In particular, the time needed to perform intervention work in subsea wells can be reduced through operations using dual wireline capabilities.

DRAWINGS AND DESCRIPTION

There will now be described, by way of example only, the above and other aspects of the invention with reference to the accompanying drawings, in which.

Figure 1A:
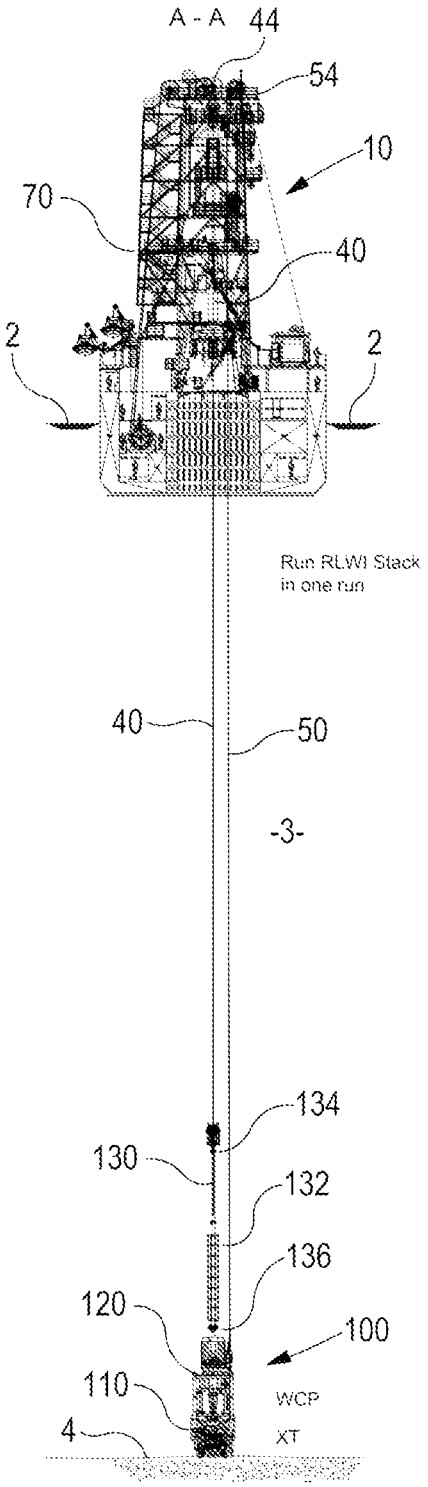
FIGS. 1A to 1D are representations of a well intervention vessel in successive steps of a method of performing intervention work in a subsea well.
Figure 1B:
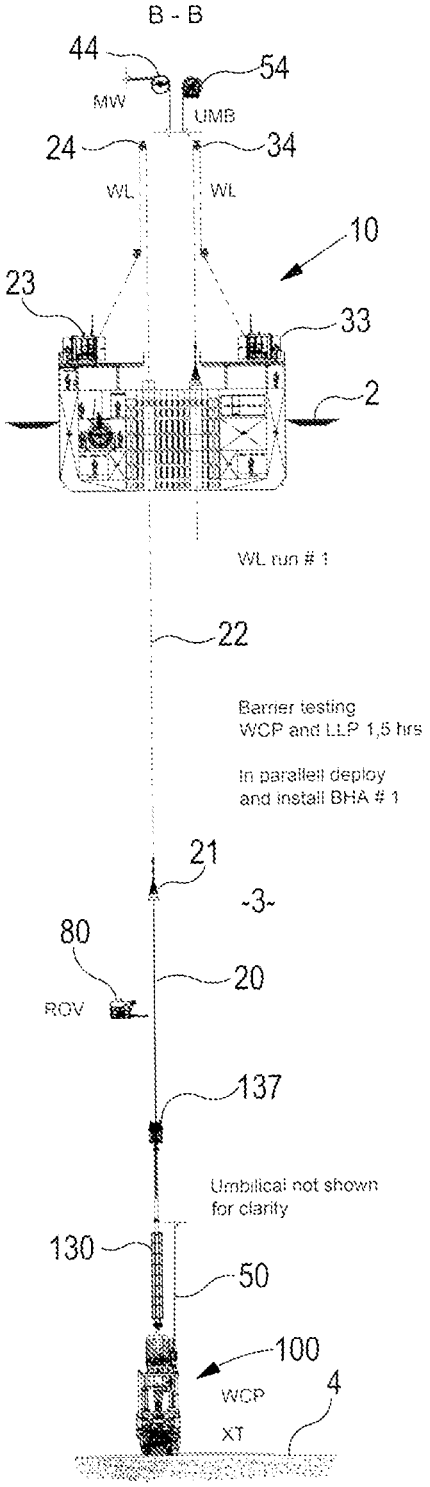
Figure 1C:
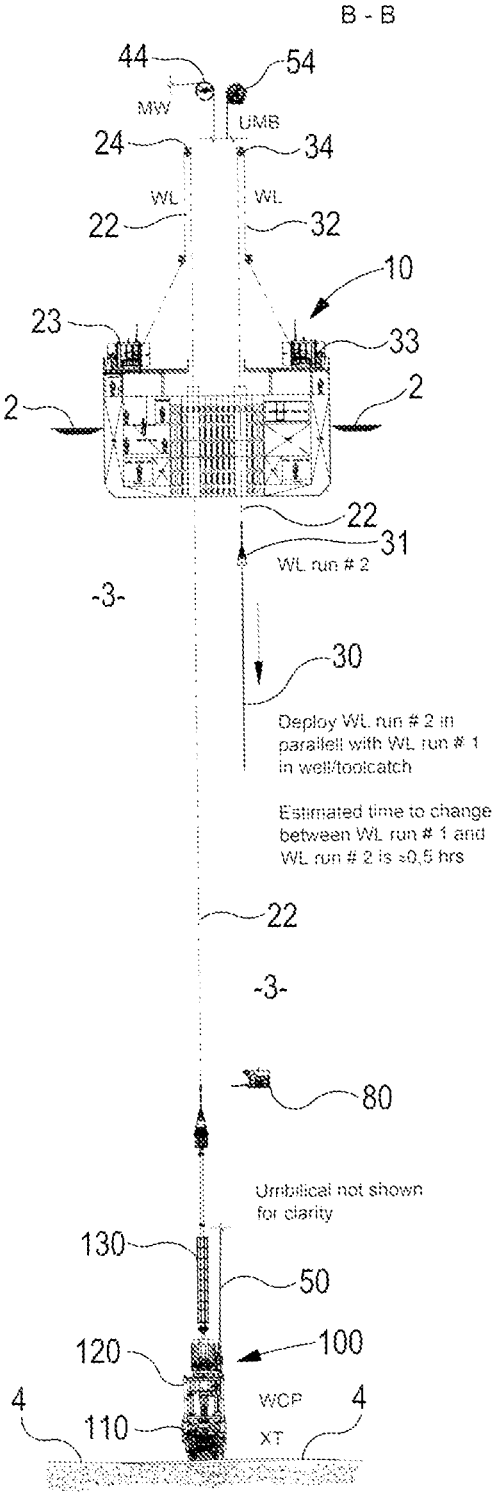

With reference to FIGS. 1A to 1D, various steps in a method of performing intervention work can be appreciated. These figures also exemplify deploying and retrieving of wellbore assemblies.

An intervention vessel 10 on a surface 2 of the sea 3 is arranged to serve a subsea well 100 at the seabed 4 on which the intervention work is to be performed. The well 100 has a Christmas tree (XT) 110 for communicating fluid in or out of the well during oil and gas production operations. The well 100 also has a well control package (WCP) 120 for controlling the well. The well control package includes for instance a blowout preventer and/or one or more valves for containing high pressure fluid in the wellbore well.

Initially, see FIG. 1A, a well access system 130 is installed on the well 100. Subsequent intervention tool strings can then be deployed on wirelines through the well access system and inserted into the wellbore of the well 100 to perform intervention work.

The well access system 130 is connected onto an upper end of the well control package 120. In this example, the well access system 130 is deployed on an end of a heavy lift wire 40 from the vessel 10. The heavy lift wire 40 is passed over a heavy lift sheave 44 on a handling tower 70 of the vessel 10. The well access system 130 includes a lubricator 132 with upper and lower valves 134, 136 which are operable to open or close a chamber inside the lubricator 132 for allowing an intervention tool string inside the chamber to exit and be lowered into the wellbore of the well beneath the seabed 4.

As can also be seen in FIG. 1A, an umbilical 50 is connected to the well 100. An end connector of the umbilical 50 is typically stabbed into a mating connector on the well 110. The umbilical 50 connects vessel services to the well. The umbilical 50 is passed over an umbilical sheave 54 on the handling tower 70 and extends from the vessel 10 through the water 3 to the well. The umbilical includes typically electrical and hydraulic lines and is connected to supply on the vessel. Electrical and hydraulic power can be supplied through these lines to operate valves or the like in the well access system and the well 100. The well access system is in the form of a RLWI stack on the well. Once the well access system 130 is connected to the well, the heavy lift wire 40 is disconnected and retrieved back to the vessel.

After providing the well with the well access system, barrier tests of the well and the well access system 130 are performed for ensuring pressure integrity and compliance. A first wireline run can then be performed, see FIG. 1B. To this end, a first tool string in the form of a bottom hole assembly (BHA) 20 is prepared on the vessel 10 and connected to an end of a first wireline 22 which is spooled out from a wireline unit 23 on the vessel. The first wireline 22 is passed over a sheave 24 on the handling tower 70. The bottom hole assembly 20 is lowered on the wireline 22 through the sea 3 toward the well 100. A remote underwater vehicle (ROV) 80 can be used to keep the bottom hole assembly 20 aligned with an entrance 137 to the access unit 130, e.g. using a manipulator to urge the wireline 22 and bottom hole assembly 20 laterally.

The bottom hole assembly 20 is used in the well 100 to perform intervention work. The well 100 is occupied through the running of the bottom hole assembly 20 and first wireline 22 into the well 100. Another, second tool string, in the form of a bottom hole assembly 30 is prepared on the vessel and is deployed on a second wireline 32, see FIG. 10. The second wireline is configured in similar way to the first and is independently operable. The second wireline 32 is passed over a sheave 34 on the handling tower 70. The bottom hole assembly 30 is lowered on the second wireline 32 through the sea 3 toward the seabed 4. The preparation and lowering of the bottom hole assembly 30 on the second wireline 32 can take place in the period during which the well 100 is occupied by the first wireline 22 and/or bottom hole assembly 20. The bottom hole assembly 30 is suspended in the water on the second wireline 32. Preferably, the bottom hole assembly 30 is lowered to a position near the well.

Figure 1D:
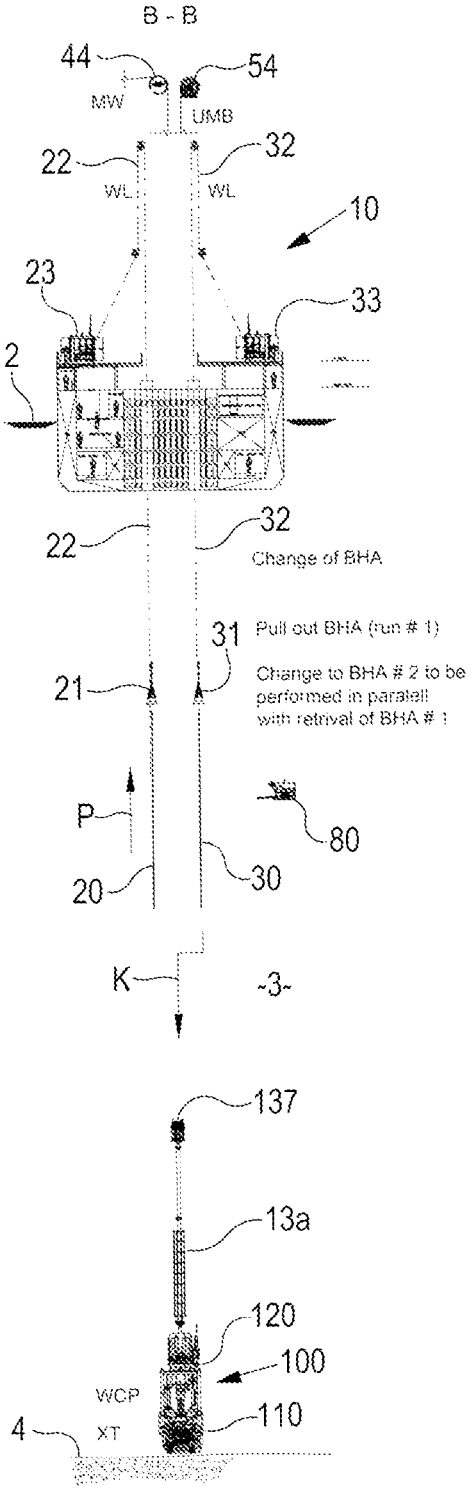

After performing the work in the well 100, the bottom hole assembly 20 is pulled out of the well on the first wireline 22, see FIG. 1D. As indicated by arrow "P" in FIG. 1D, the bottom hole assembly 20 is retrieved toward the surface 2 and brought back onto the vessel 10. The bottom hole assembly 30 on the second wireline 32 is aligned with the entrance 137 of the well access system 130 and is inserted in into the well 100 through the access system 130. The bottom hole assembly 30 is inserted into the well in the period during which the first bottom hole assembly 20 is being retrieved. The ROV 80 can be used to align the second wireline 32 and/or the bottom hole assembly 30 to bring it into alignment from a standby position such as indicated in FIG. 1D, e.g. by exerting a lateral force that urges the bottom hole assembly 30 into aligned position laterally. The bottom hole assembly 30 is used to perform further intervention work in the well 100. Preferably, the bottom hole assembly 30 is inserted as soon as the bottom hole assembly 20 on the first wireline 22 has been pulled out and is sufficiently clear of the top of the well to allow access by another bottom hole assembly 30.

The bottom hole assembly 30 is for example equipped with different tools to the bottom hole assembly 20. The ratings of the first and second wirelines 22, 32 can be different in such an example to accommodate different weight or other characteristic of the tools.

By way of the dual wireline system with first and second wirelines 22, 32 that are independently operable, the bottom hole assembles 20, 30 can be suspended from the vessel simultaneously and one can be prepared and positioned near the well while the other occupies the well in an intervention operation. This can save significant amounts of time in the performance of intervention. Time spent on performing work in the well can be maximised. The cost reductions offered can allow wells to be serviced that otherwise may be disregarded as candidates, allowing well operators to bring wells into operation and increase production which otherwise may not have been possible. The service provided by the present technique can therefore increase cost efficiency. Furthermore, by having dedicated wirelines for the respective bottom hole assemblies 20, 30 can allow the wirelines and bottom hole assemblies to be prepared and adapted for deployment on an individual basis. The wirelines may be selected for specific requirements of the tool strings to be deployed. Preparation and deployment on individual basis and in separate procedures can simplify process and testing before deployment, allow intervention work to commence sooner, and gives flexibility in sequencing of procedure (e.g. by preparing and deploying the second tool string later). Personnel teams can work and prepare one of the tool strings/wirelines at a time and/or work in parallel. Resources and expertise in the personnel teams may be deployed more effectively, whilst still allowing the second bottom hole assembly 30 to quickly replace the first bottom hole assembly 20 in the well.

Figure 2:
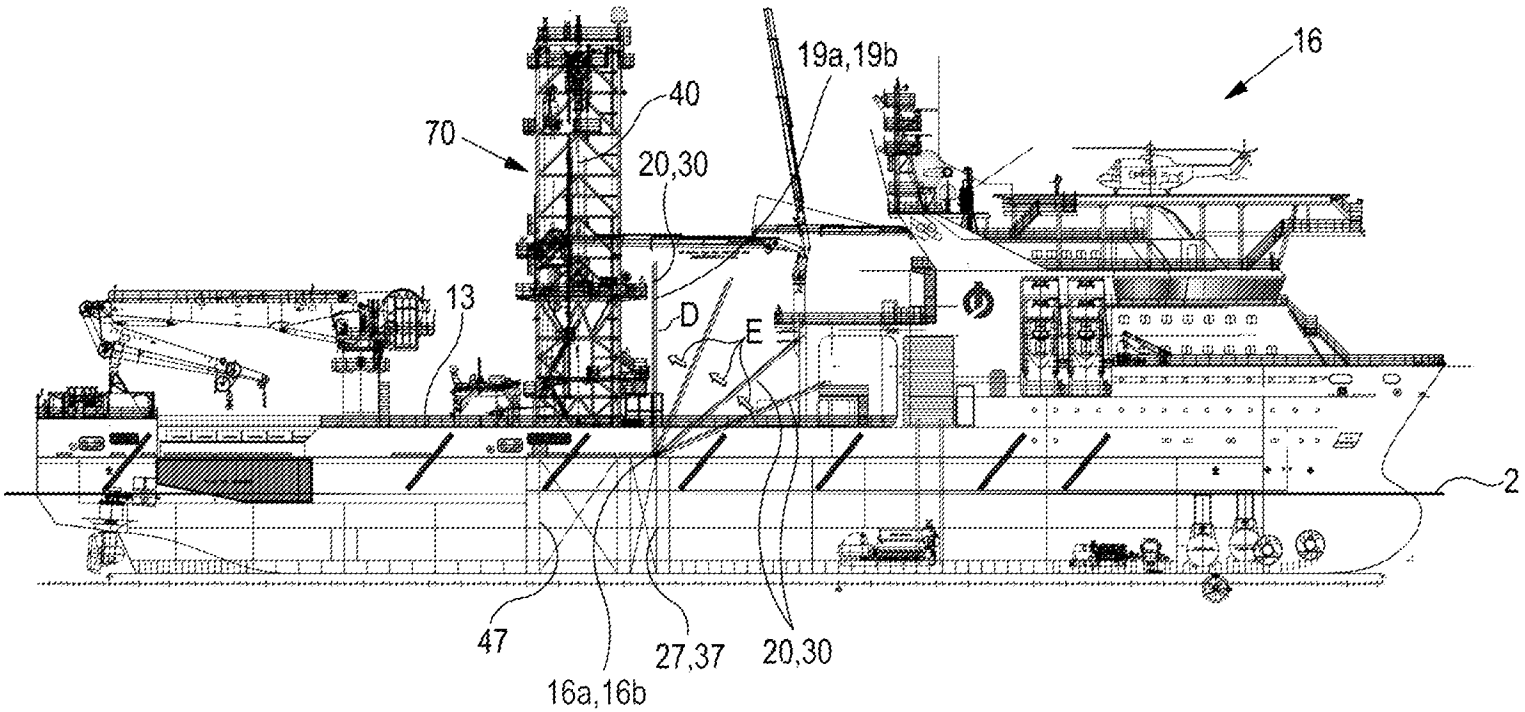
FIG. 2 is a side representation of a well intervention vessel for use in performing the method of FIGS. 1A to 1D.
Figure 4:
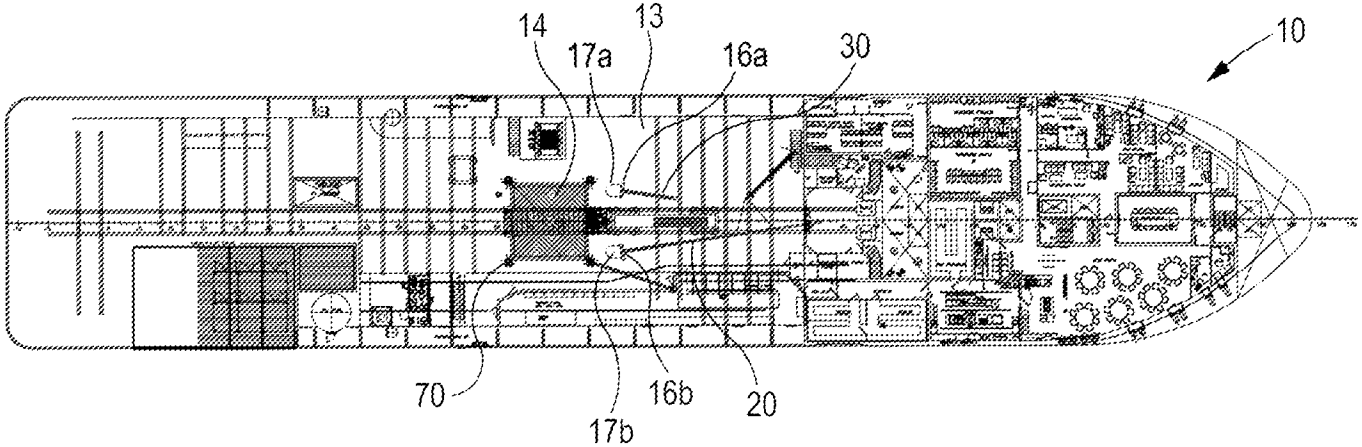
FIG. 4 is a top view representation of the main deck of the well intervention vessel of FIG. 2 in the preparation of a second tool string.
Figure 3:
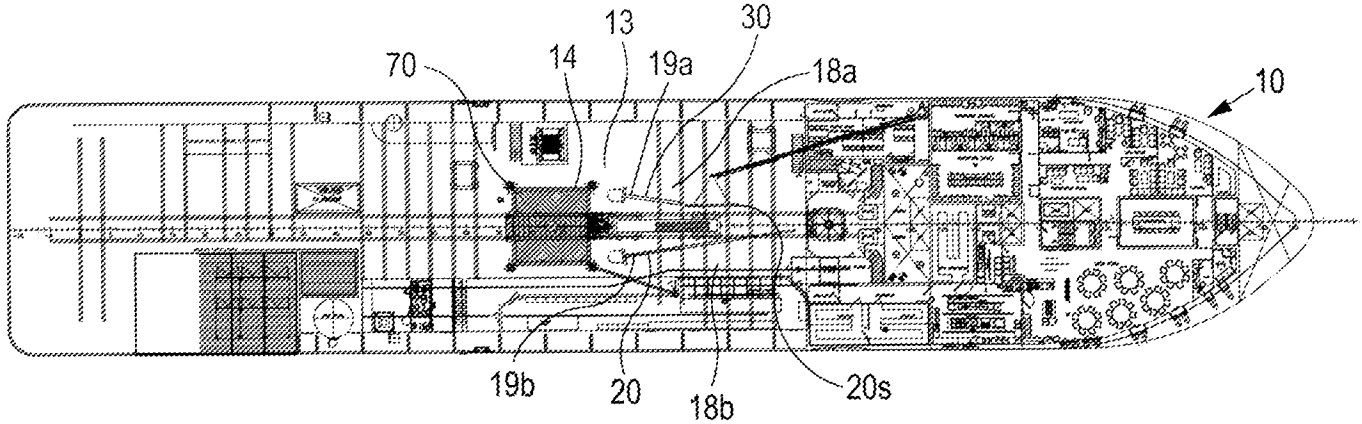
FIG. 3 is a top view representation of a main deck of the well intervention vessel of FIG. 2 in the preparation of a first tool string.

With reference additionally to FIGS. 2 to 4, the apparatus for performing the method is described in more detail, and includes the vessel 10 which comprises the lifting and handling tower 70 that extends vertically upward from a main deck 13 of the well intervention vessel 10. The height of the tower is such that the tool strings can be arranged vertically and connected to the wireline to be suspended from the tower above the main deck 13 level. On an inside of the tower 70, the main deck has a heavy lift area 14, which is a personnel restricted area. The well access system 130 is deployed on the heavy lift wire 40 through the main moon pool 47 into the sea below the vessel 10.

The well intervention vessel 10 is further provided with two further dedicated wireline moon pools 27, 37 for deployment respectively of the tool strings 20, 30 on wirelines 22, 32 through the moon pools 27, 37 into the sea below the vessel. The moon pools 27, 37 facilitate organisation of the wirelines and tool strings on spaced apart trajectories when both tool strings are deployed and suspended in the water, as can be appreciated additionally with reference now to FIG. 5. This may help to prevent entanglement or other undesired interaction between the two during retrieval and deployment.

Deck hatches 17*a*, 17*b* in the main deck 10 provide openings to the moon pools 27, 37. These allow the tool strings 20, 30 on wirelines 22, 32 to pass through the openings, through the moon pool and into the sea for deployment, and vice versa during retrieval. The hatches 17*a*, 17*b* are spaced away from the heavy lift area 14. The hatches 17*a*, 17*b* are arranged on the side of the tower facing bow-ward, although in other examples the moon pools 27, 37 could be arranged stern-side of the tower.

The vessel 10 has designated preparation areas 18*a*, 18*b* to prepare the tool strings for deployment, these areas 18*a*, 18*b* also separate from the heavy lift area 14 and arranged in this case on respective sides of the main deck 13 of the vessel. This arrangement of the preparation areas 18*a*, 18*b* allows the wirelines and tool strings to be prepared by personnel in the areas 18*a*, 18*b* whilst heavy lifting and handling, e.g. in particular the lowering and deployment of the umbilical 50 and the well access system 130 (see FIG. 1A), is performed inside the tower 70. The arrangement of the wireline hatches 17*a*, 17*b* on the front side of the tower allows wireline deployments, e.g. deploying tool strings 20, 30 on the first and/or second wirelines 22, 32, to take place and/or be initiated in the period during which the heavy lift area 14 is engaged, e.g. in the lifting and handling and deployment of the well access system 130 and/or umbilical 50.

In FIGS. 3 and 4, the bottom hole assemblies 20, 30 are shown in different stages of preparation. Sections of the bottom hole assemblies 20, 30 are assembled end to end in generally horizontal configuration at deck level. In FIG. 3, a section 20*s* is lifted into place to form the tool string 20 as seen in FIG. 4. The second tool string 30 is prepared similarly.

The tool strings 20, 30 are arranged and typically assembled in respective supports in this example in the form of elongate channels 19*a*, 19*b*, proximal ends of which are pivotably connected to the deck 13 by hinges 16*a*, 16*b*. The tool strings 20, 30 in the support channels can then be rotated about a horizontal axis from the substantially horizontal preparation position of FIGS. 2 to 4 where the tool strings extend laterally for assembly by deck personnel, to the vertical, deployment position as indicated by "D" in FIG. 2 where the tool strings 20, 30 are positioned so as to extend along the tower above the hatches 27, 37. The first and second wirelines 22, 32 from sheaves 24, 34 in the tower can then be connected. The tool strings 20, 30 can be brought into the deployment position D by lifting distal ends of the support channels 19*a*, 19*b* and/or tool strings 20, 30 e.g. using a small crane, to pivot the supported tool strings 20, 30 into the position D. The rotational movement can be appreciated from arrows "E" in FIG. 2.

Figure 5:
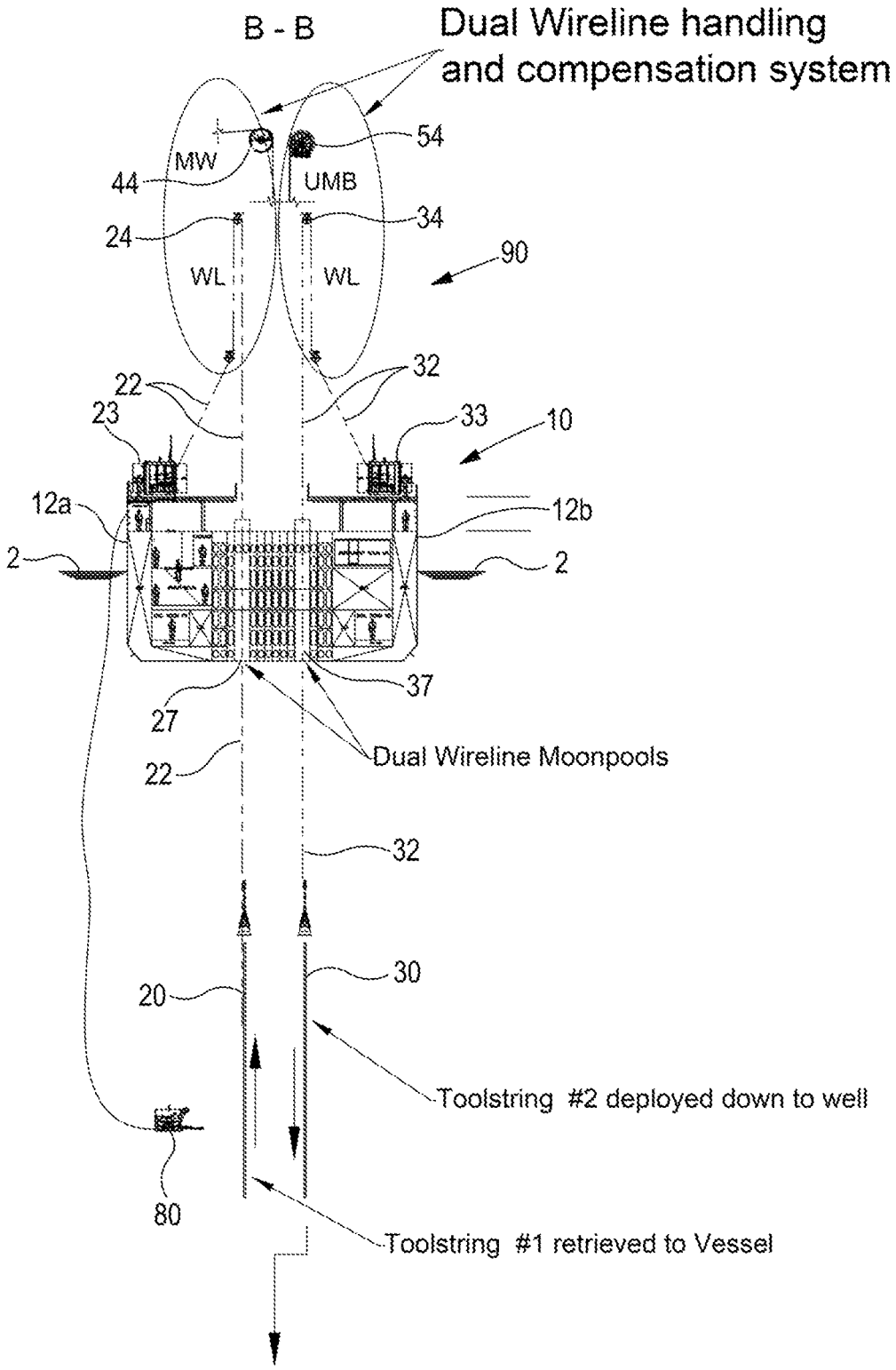
FIG. 5 is a sectional representation of the well intervention vessel of FIG. 2 with two tool strings deployed in the sea.

The tool strings 20, 30 on first and second wirelines 22, 32 are both suspended from the vessel in the sea in FIG. 5. The first tool string 20 is being retrieved after use in the well, and the second tool string 30 is being deployed toward the seabed for insertion into the well. The wirelines 22, 32 extend through separate moon pools 27, 37.

The vessel 10 is provided with a dual wireline handling and compensation system generally depicted in FIG. 5 by reference numeral 90. This system 90 includes the various sheaves 24, 34, 44, 54 supported on the tower 70, and heave compensation means by which the effects of heave upon the vessel are counteracted so as not to substantially affect the tension or position relative to the seabed of the tool strings 20, 30, heavy lift wire 40, or the umbilical 50 during operations. The heave compensation functionality can be implemented in various ways, e.g. by spooling in or out on the winches of wireline units 23, 33 to which the various lines are connected, in response to the amount of heave, or by applying hydraulic cylinders between hull of the vessel and the units from which the lines 20, 30, 40, 50 are spooled out extend or retract to "absorb" the heave motion that the hull experiences.

The vessel 10 also has dynamic positioning system, which can allow the vessel 10 to stay on station and serve the well appropriately for performing intervention work. This allows it to keep in position and maintain the desired heading relative to the subsea well with high accuracy, without seabed anchoring. The vessel is therefore versatile, suitable for accurate positioning to serve deep water wells, and can be readily moved to other well sites, e.g. to complete a programme of intervention on multiple wells in an efficient and cost-effective manner. The vessel position may also be adjusted slightly between steps of the intervention process to facilitate aligning the wirelines 20, 30, heavy lift wire 40, or umbilical 50 laterally with respect to the well for assisting their deployment in or installation on the subsea well.

Figure 6:
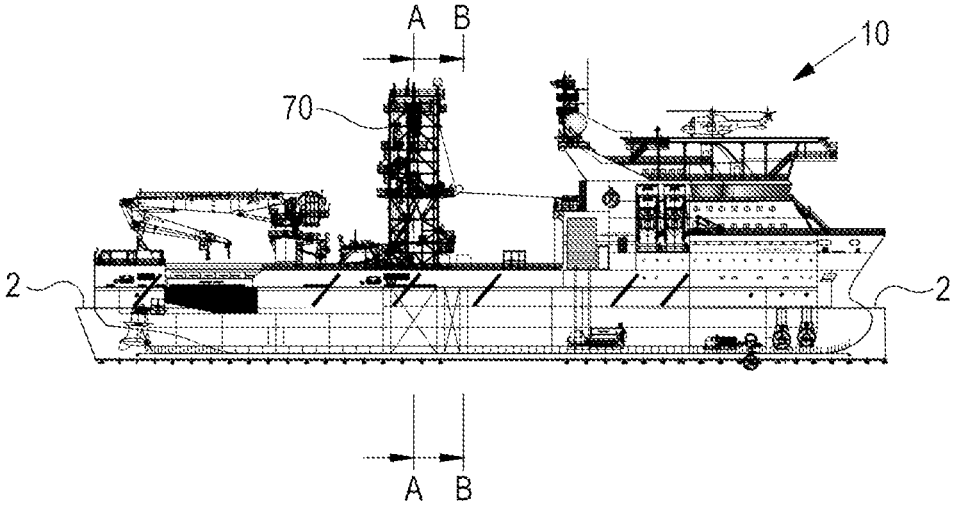
FIG. 6 is a side view representation of the well intervention vessel indicating the location of sections A-A and B-B which appear amongst FIGS. 1A to 1B and FIG. 5.

For reference, FIG. 6 illustrates the vessel 10 and the locations of cross-sections of the vessel in the FIGS. 1 to 5 discussed above.

The intervention vessel 10 in this example is a lengthened well server vessel, such as M/V Island Well Server lengthened between the Modular Handling Tower (MHT) and the vessel superstructure, at existing frame 82/83 with 24.7 meters (38 frames). The two dedicated wireline moon pools 27, 37 are part of the lengthened section. This lengthened section provides a further main deck area and an A-deck dedicated for wireline operations.

Figure 7:
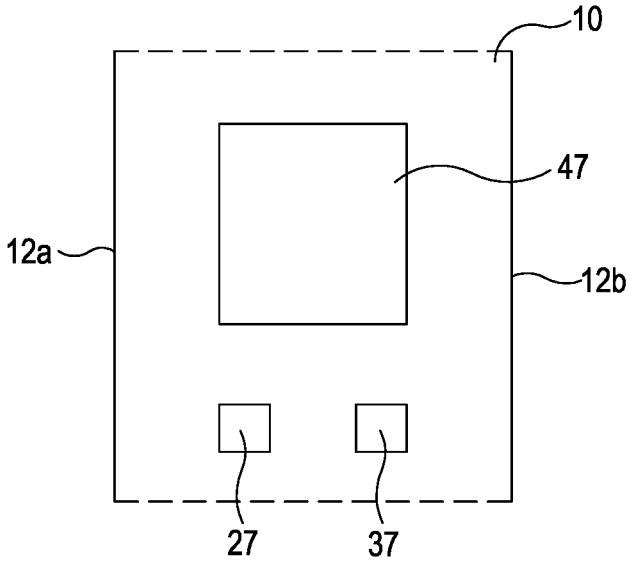
FIG. 7 is a plan view of the moon pools of the vessel.

The vessel 10 described above is of course merely an example of how the vessel may be configured. The arrangement of the moon pools 27, 37, 47 is generally, as shown in FIG. 7. That is, the vessel 10 has a main moon pool 47 for heavy lifting and handling underneath and/or inside the tower 70 and two smaller, separate individual moon pools 27, 37 for wireline deployments.

Figure 8:
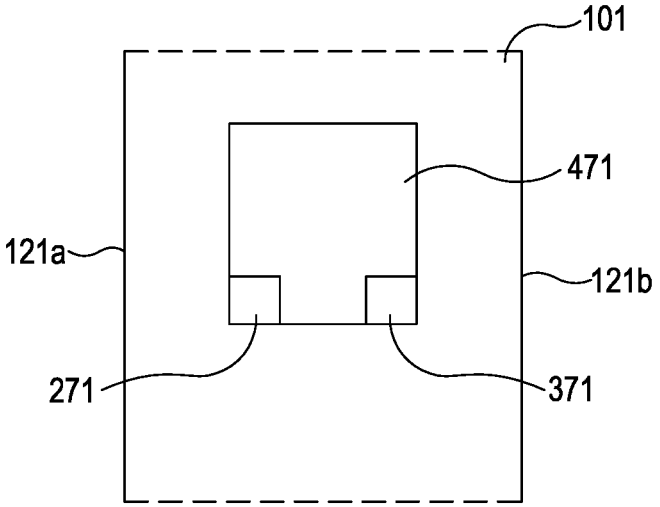
FIG. 8 is a plan view of a different arrangement of moon pools on the vessel.

In FIG. 8, a different arrangement is exemplified in which a section of well intervention vessel 101 has a moon pool 471 which has a main region 471*m* for heavy lifting or ROV deployment under a lifting and handling tower, a region 271 for first wireline deployment and a region 371 for second wireline deployment. The regions 271, 371 for wireline deployment are in two of the corners of the moon pool, i.e. those toward the bow end of the ship. In other variants, the regions 271, 371 are in the corners toward the stern end. The regions 271, 371 can be accessed through hatch apertures in an overlying deck through which the wireline and tool strings are fed, similar to the manner provided by hatches 17*a*, 17*b* of the vessel 10. Tower and preparation areas are provided on the vessel 101 for preparing the tool strings and positioning them over the hatches for deployment is for example as described above for the vessel 10.

Figure 9:
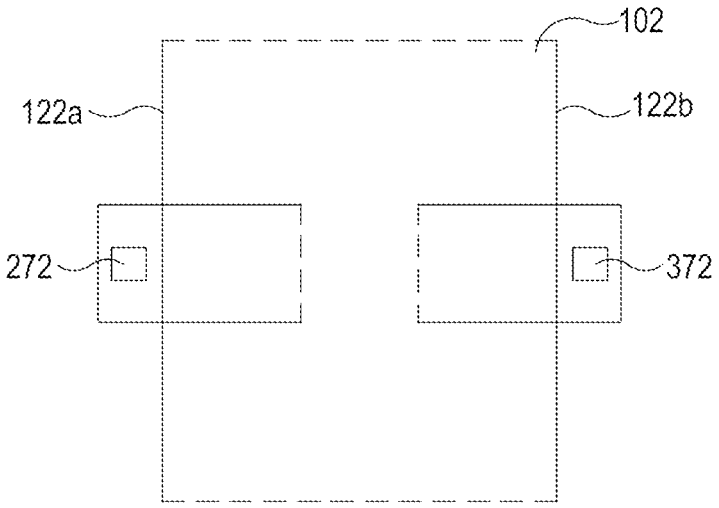
FIG. 9 is a plan view of an arrangement for deploying tool strings on wirelines over the sides of the vessel.

In FIG. 9, provision is made for wireline deployments into the sea over the sides 122*a*, 122*b* of the vessel 102. The vessel 102 has cantilever structures extending over the sides 122*a*, 122*b* with respective openings 272, 372 through which first and second tool strings 20, 30 are deployable and/or retrievable on wirelines. In this vessel 102, no moon pools are required for the wirelines. Indeed, it may not include or require any moon pool at all. Preparation areas and supports are provided for assembling and bringing the tool strings into position above the openings 272, 372 as appropriate.

It can be noted that the extended well server vessel 10 is used merely as an example vessel comprising a dual wireline system (constituting apparatus for dual deployment and retrieval of wellbore assemblies). The system can be implemented on any vessel given the ability to operate two separate wireline systems including the deployment system. Purpose built dual wireline moon pools help to run wirelines in parallel, which can increase overall service efficiency hence reduce cost of the service. Given a correct layout, dual wireline operations could also be performed through the larger moon pool either dedicated for this type of operation or a general service moon pool. In areas of the world where the general sea and weather conditions permit dual wireline operations could also be performed over the vessel side by use of dedicated handling equipment, such as indicated in FIG. 9.

It can be further appreciated that the wireline system in the example of the vessel 10 includes a complete dual wireline spread with two wireline tool deployment moon pools, compensation systems, and wireline winches with operator facilities and tool handling systems. Three complete units could be accommodated on each side in addition to two spare units.

The wireline system is preferably set up as two independent systems allowing operators to prepare, build, test and store a bottom hole assembly that is ready to be deployed as a parallel activity to an ongoing wireline run. Each individual wireline spread typically includes wireline winch sets with the different cables, wireline compensators, BHA build, vertical to horizontal and support device, PCH winches with cursors for PCH, and wireline moon pool.

The system can be considered in practical terms a double system allowing for preparation and deployment of the next BHA down to the seabed/wellhead while the first BHA is in operation inside the well. This possibility can reduce or minimize the time from "catch-to-catch" and hence increase the overall service efficiency.

BHA change catch-to-catch can be defined as:

Tool-string catch
Close UPIV
Flushing and testing of stack
Disconnect and lift off PCH and BHA
Swap BHA and PCH subsea
Guiding and stabbing of new BHA into lubricator
Locking of PCH connector
Flushing and testing of stack
UPIV ready to open The systems can for example include a Port Side (PS) system and a Starboard Side (SB) system. The respective systems are self-contained and complete in the sense that one can operate independently if the other should be down.

Three wireline units on the A-deck of the vessel 10 (above the main deck 13) can be lined up and connected to a control system ready for operation. The combination of wire types operated from each individual wireline unit can be changed offshore as required. In addition, two more complete spare units can be located on A-deck. All such units could be replaced offshore both by skidding and lifting by an onboard crane e.g. one located on top of an ROV moon pool structure. The crane can also be used for lifting operations on main deck forward of tower 70 including lifting of BHA's out of and into baskets.

A forward wall or structure of the modular handling tower (MHT) 70 has been equipped with dual vertical guiding rails for guiding of a pressure control head (PCH) 21, 31 during deployment and for guiding of compensated wireline sheave during operations. The compensated sheave 24, 34 can be lowered down to deck level to minimize working in height when changing from one wireline type/size to another for improved efficiency and better health and safety environment (HSE).

On the main deck 13 a tool-lifting and deployment unit is installed, including the support channel 19*a*, 19*b*, allowing full BHA length of 25 meters to be built and tested horizontally prior to lifting and deployment vertically through either of the two dedicated moon pools 27, 37. Handling of the PCH 21, 31 on each system can take place by means of a dedicated handling system.

In order to meet requirements for increased efficiency and reduced cost in a vessel based Light Well Intervention (LWI) service, a dual wireline operational solution as described can be advantageous. Having completed the first wireline run the tool-string is retrieved back to the vessel a redressed or alternatively, a new tool string is connected to the wireline and deployed into the well. This can provide significant efficiency benefits. For example, the solution may reduce times between BHA runs in the well to less than 2.5 hr on typical offshore wells, compared with around 7.5 hours in conventional solutions.

The improvements can be achieved through provision of one or more of following:

parallel wireline operations with two BHA's suspended on wirelines and in movement simultaneously;
dual wireline winch spreads for simultaneous operation and/or preparation of two BHA's
PCH's with deployment winches and active heave compensators for each WL moonpool
BHA building and handling system for support of two BHA's Although well intervention work is described above, it can be appreciated that the techniques can be applied equally for deploying or retrieving other equipment on wirelines in corresponding manner.

Wirelines are described in the above examples merely as examples of flexible elongate members. In other examples therefore, the first wireline is replaced by a flexible elongate member and/or the second wireline is replaced by a flexible elongate member, where the flexible elongate member is in the form of any one of: a slickline; a rod or a cable, e.g. a tubular rod or cable, of for example synthetic fibre, metal(s), plastics, or composite material; a hose; an e-line cable; or coiled tubing. The flexible elongate member can be stored coil-wise on a drum which can be driven by a motor, e.g. such as a winch or other spool unit. It can then be spoolable in or out with respect to the drum to run the wellbore assembly through the sea from the vessel and into the well, and vice versa, in the same way as described above for the wireline examples above.

The invention claimed is:

1. A method of performing well intervention work in a subsea well which is provided with a subsea well control package and a subsea well access system on the well, the well access system comprising a lubricator, the method comprising the steps of:

(a) providing a well intervention vessel and dynamically positioning the well intervention vessel over the well;
(b) suspending a first tool string on a first spooled flexible elongate member that extends into the sea from the well intervention vessel, inserting the first tool string on the first spooled flexible elongate member into the well through the lubricator, and using the first tool string on the first spooled flexible elongate member to perform intervention work in the well;
(c) suspending a second tool string on a second spooled flexible elongate member that extends into the sea from the well intervention vessel, wherein the second tool string is located in the sea for a period of time before insertion into the well, the first tool string being used in the well in said period of time;
(d) removing the first tool string on the first spooled flexible elongate member from the well and from the lubricator;
(e) after step d, inserting the second tool string on the second spooled flexible elongate member into the well through the lubricator; and
(f) using the inserted second tool string on the second spooled flexible elongate member in the well to perform further intervention work.

2. The method as claimed in claim 1, wherein the first and second spooled flexible elongate members are both wirelines.

3. The method as claimed in claim 1, which further comprises a step of retrieving the removed first tool string toward surface on the first spooled flexible elongate member, and inserting the second tool string on the second spooled flexible elongate member into the well, and/or into the well access system on the well, and/or using the second tool string in the well, in the period of retrieving the first tool string on the first spooled flexible elongate member, wherein the first tool string is suspended in the sea on the first spooled flexible elongate member in the period of retrieval.

4. The method as claimed in claim 1, wherein step (e) comprises inserting the second tool string on the second spooled flexible elongate member into the well or into the well access system on the well (i) before the removed first tool string on the first spooled flexible elongate member has arrived at or near the well intervention vessel, (ii) before the removed first tool string on the first spooled flexible elongate member is received in a moon pool of the well intervention vessel, (iii) before the removed first tool string on the first spooled flexible elongate member obtains a position in the sea upon retrieval that is nearer the well intervention vessel than the seabed.

5. The method as claimed in claim 1, wherein the second tool string on the second spooled flexible elongate member is inserted into an entrance of the well, or the well access system on the well, before the first tool string on the first spooled flexible elongate member is retrieved to the surface and/or brought on board the well intervention vessel.

6. The method as claimed in claim 1, which includes providing the well with the well access system comprising an upper end which is located subsea, wherein the second tool string on the second spooled flexible elongate member enters from the sea through an entrance of the upper end of the well access system.

7. The method as claimed in claim 1, which further comprises using an underwater manipulator to urge the second spooled flexible elongate member laterally to help to align the second tool string on the second spooled flexible elongate member in the sea with an entrance to the lubricator.

8. The method as claimed in claim 1, which further comprises deploying or retrieving the first and second tool strings on the respective first and second spooled flexible elongate members into the water through at least one moon pool of the well intervention vessel.

9. The method as claimed in claim 8, wherein the first tool string on the first spooled flexible elongate member is deployed or retrieved through a first moon pool of the well intervention vessel, and the second tool string on the second spooled flexible elongate member is deployed or retrieved through a second moon pool of the well intervention vessel that is separate from the first moon pool, wherein the first and second moon pools are arranged laterally and/or transversely apart on port and starboard sides of a longitudinal midline of a hull of the well intervention vessel.

10. The method as claimed in claim 8, wherein the first tool string on the first spooled flexible elongate member is deployed or retrieved through a first region of water of the moon pool, and the second tool string on the second spooled flexible elongate member is deployed or retrieved through a second region of water of the moon pool.

11. The method as claimed in claim 1, which further includes prior to using the first tool string to perform the work in the well, providing the well with the well access system by suspending at least one connecting part of the well access system on one of the first or second spooled flexible elongate members, and using the one of the first or second spooled flexible elongate member on which the connecting part is suspended to position and arrange the part for connection to the well.

12. The method as claimed in claim 1, which further comprises using an underwater manipulator to urge the first spooled flexible elongate member laterally to help to align the first tool string on the first spooled flexible elongate member in the sea with an entrance to the lubricator.

13. A method of deploying and retrieving tool strings for performing well intervention work, the method comprising:

providing a well intervention vessel having independently operable first and second spool units;

operating the first spool unit to spool in a first flexible elongate member to remove and retrieve a first tool string from a well and through a lubricator on an end of the first flexible elongate member, the first tool string being suspended in the sea during the retrieval; and operating the second spool unit to spool out a second flexible elongate member to deploy and insert a further, second tool string into the well and through the lubricator on an end of the second flexible elongate member, the second tool string being suspended in the sea during the deployment.

14. The method as claimed in claim 13, wherein the first and second elongate members are both wirelines.

15. A method of performing an intervention program for subsea wells, which comprises performing the method comprising the steps of:

(a) providing a well intervention vessel;

(b) upon successful completion of a barrier test of a well, suspending a first tool string on a first flexible elongate member that extends into the sea from the well intervention vessel, and using the first tool string on the first flexible elongate member to perform work in the well;

(c) suspending a second tool string on a second flexible elongate member that extends into the sea from the well intervention vessel, wherein the second tool string is located in the sea for a period of time before insertion into the well, the first tool string being used in the well in said period of time;

(d) removing the first tool string on the first flexible elongate member from the well;

(e) after step d, inserting the second tool string on the second flexible elongate member into the well; and (f) using the inserted second tool string on the second flexible elongate member in the well to perform further work;

in any one or more of the wells in the program to perform intervention work.

16. An apparatus for use in performing a method comprising the steps of:

(a) providing a well intervention vessel;

(b) suspending a first tool string on a first spooled flexible elongate member that extends into the sea from the well intervention vessel, inserting the first tool string on the first spooled flexible elongate member in a well through a lubricator, and using the first tool string on the first spooled flexible elongate member to perform intervention work in the well;

(c) suspending a second tool string on a second spooled flexible elongate member that extends into the sea from the well intervention vessel, wherein the second tool string is located in the sea for a period of time before insertion into the well, the first tool string being used in the well in said period of time;

(d) removing the first tool string on the first spooled flexible elongate member from the well and from the lubricator;

(e) after step d, inserting the second tool string on the second spooled flexible elongate member into the well through the lubricator; and (f) using the inserted second tool string on the second spooled flexible elongate member in the well to perform further intervention work, the apparatus comprising the first and second spooled flexible elongate members which each comprise an end to be connected to a tool string and which are independently spoolable.

17. The apparatus as claimed in claim 16, wherein the first and second spooled flexible elongate members comprise first and second wirelines, and wherein the apparatus further comprising: first and second wireline units, the first and second wirelines being spoolable independently in or out from the respective wireline units; and first and second sheaves for supporting the first and second wirelines on a frame in use, wherein the first and second wirelines are heave compensated.

18. The apparatus as claimed in claim 16, the apparatus further comprising:

first and second spool units;

wherein the first and second spooled flexible elongate members are spoolable independently in or out on the first and second spool units respectively;

wherein the first tool string is deployed or retrieved on the first spooled flexible elongate member; and wherein the second tool string is deployed or retrieved on the second spooled flexible elongate member.

19. The apparatus as claimed in claim 18, wherein in at least one mode of dual operation, the first unit is operative to spool in the first spooled flexible elongate member to remove and retrieve the first tool string on the first spooled flexible elongate member from the well through the lubricator on the well, and the second unit is operative to spool out the second spooled flexible elongate member to deploy and insert the second tool string on the second spooled flexible elongate member into the well through the lubricator.

20. A light well intervention vessel comprising an apparatus for use in performing a method comprising the steps of:

(a) suspending a first tool string on a first spooled flexible elongate member that extends into the sea from the well intervention vessel, inserting the first tool string on the first spooled flexible elongate member in a well through a lubricator, and using the first tool string on the first spooled flexible elongate member to perform intervention work in the well;

(b) suspending a second tool string on a second spooled flexible elongate member that extends into the sea from the well intervention vessel, wherein the second tool string is located in the sea for a period of time before insertion into the well, the first tool string being used in the well in said period of time;

(c) removing the first tool string on the first spooled flexible elongate member from the well and from the lubricator;

(d) after step c, inserting the second tool string on the second spooled flexible elongate member into the well through the lubricator; and (e) using the inserted second tool string on the second spooled flexible elongate member in the well to perform further intervention work;

the apparatus comprising the first and second spooled flexible elongate members which each comprise an end to be connected to a tool string and which are independently spoolable.

21. The light well intervention vessel as claimed in claim 20, further comprising a first moon pool through which the first spooled flexible elongate member can pass and a separate, second moon pool through which the second spooled flexible elongate member can pass, for suspending the first and second tool strings on the first and second spooled flexible elongate members in the water simultaneously below the light well intervention vessel, wherein the first and second moon pools are arranged laterally and/or transversely apart on port and starboard sides of a longitudinal midline of a hull of the light well intervention vessel.

* * * * *